US009382736B2

(12) United States Patent
Tejima

(10) Patent No.: US 9,382,736 B2
(45) Date of Patent: Jul. 5, 2016

(54) IMAGE FORMING APPARATUS HAVING ENGAGING MEMBER FOR HOLDING A COVER IN AN OPENED POSITION AND A CLOSED POSITION

(71) Applicant: FUJI XEROX CO., LTD., Tokyo (JP)

(72) Inventor: Satoshi Tejima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 58 days.

(21) Appl. No.: 14/196,782

(22) Filed: Mar. 4, 2014

(65) Prior Publication Data

US 2015/0040483 A1 Feb. 12, 2015

(30) Foreign Application Priority Data

Aug. 12, 2013 (JP) ..... 2013-167715

(51) Int. Cl.

| | |
|---|---|
| ***E05D 11/10*** | (2006.01) |
| ***E05D 11/06*** | (2006.01) |
| ***E05D 1/04*** | (2006.01) |
| ***B41J 29/13*** | (2006.01) |

(52) U.S. Cl.

CPC ..... *E05D 11/1007* (2013.01); *B41J 29/13* (2013.01); *E05D 1/04* (2013.01); *E05D 11/06* (2013.01); *E05Y 2900/602* (2013.01)

(58) Field of Classification Search

IPC ..... E05D 11/1007,11/06, 11/1028, 11/1078, E05D 11/05; Y10T 16/542, 16/6295

See application file for complete search history.

(56) References Cited

U.S. PATENT DOCUMENTS

| | | | | | |
|---|---|---|---|---|---|
| 2,812,536 | A * | 11/1957 | Ragsdale | 16/332 |
| 2,979,355 | A * | 4/1961 | Brown, Jr. | 292/76 |
| 3,579,712 | A * | 5/1971 | Smith | 16/329 |
| 5,061,023 | A * | 10/1991 | Soubliere et al. | 312/223.4 |
| 6,353,968 | B1 * | 3/2002 | Shyu | E05D 11/1007 16/334 |
| 2010/0293749 | A1 * | 11/2010 | Ohashi et al. | 16/273 |
| 2012/0317751 | A1 * | 12/2012 | Nagami | E05D 11/1028 16/328 |
| 2014/0320582 | A1 * | 10/2014 | Sauvage et al. | 347/218 |

FOREIGN PATENT DOCUMENTS

| | | | |
|---|---|---|---|
| FR | 2 982 525 | * | 5/2013 |
| JP | A-11-084982 | | 3/1999 |
| JP | A-2007-065402 | | 3/2007 |

* cited by examiner

*Primary Examiner* — Gregory Strimbu
(74) *Attorney, Agent, or Firm* — Oliff PLC

(57) ABSTRACT

A cover structure including a cover member movable between open and closed positions relative to an apparatus body, a supporting member that includes one end portion fixed to the cover member and another end portion attached to the apparatus body, the supporting member supports the cover member in the open position thereof, the apparatus body includes an engaging member that engages the supporting member to resist the movement of the supporting member and engages a portion of the supporting member when the cover member is in the closed position to maintain the cover member in the closed position.

4 Claims, 9 Drawing Sheets

IMAGE FORMING APPARATUS HAVING ENGAGING MEMBER FOR HOLDING A COVER IN AN OPENED POSITION AND A CLOSED POSITION

CROSS-REFERENCE TO RELATED APPLICATIONS

This application is based on and claims priority under 35 USC 119 from Japanese Patent Application No. 2013-167715 filed Aug. 12, 2013.

BACKGROUND

Technical Field

The present invention relates to a cover opening/closing structure, and an image forming apparatus having the same.

SUMMARY

According to an aspect of the invention, there is provided a cover opening/closing structure including:

a cover member that performs an opening/closing operation with one end side as a rotation center with respect to an apparatus body;

a supporting member that includes one end portion fixed to the cover member and the other end portion locked to the apparatus body to support the cover member in an opened state; and an engaging member that is provided at the apparatus body to give resistance to the supporting member with the opening/closing operation of the cover member, and that engages a portion to be engaged, which is provided at the supporting member to maintain the cover member in a closed state.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail with reference to the drawings. In addition, for convenience of description, as appropriately shown in FIG. 1, arrow UP is defined as an upward direction, arrow FR is defined as a front direction, and arrow RI is defined as a right direction. Additionally, when an up-and-down direction, a front-and-rear direction, and a left-and-right direction are described without being specially mentioned in the following description, these directions represents upward and downward in the up-and-down direction, front and rear in the front-and-rear direction, and left and right in the left-and-right direction, in the closed state of a cover member 22 to be described below.

Figure 1:
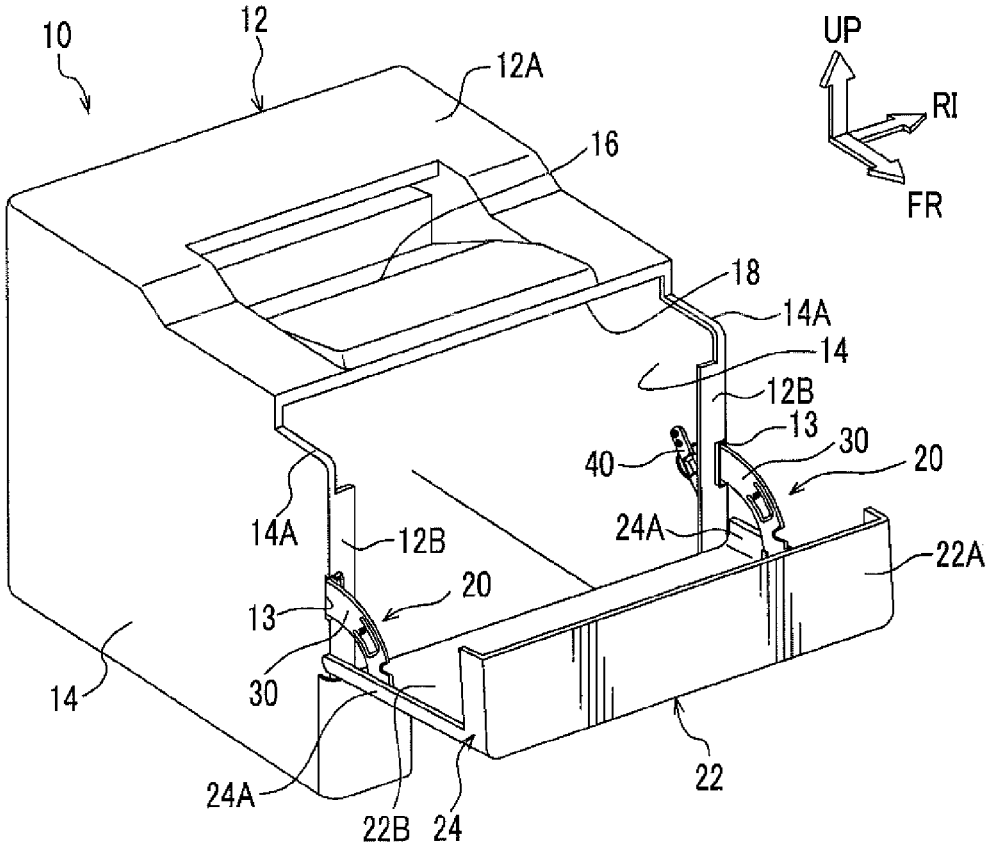
FIG. 1 is a schematic perspective view showing an image forming apparatus having a cover opening/closing structure according to the present exemplary embodiment.

As shown in FIG. 1, an image forming apparatus 10 includes an apparatus body 12. An image forming section (not shown) that forms an image on a recording sheet (not shown) as an example of a recording medium, and a sheet transporting section (not shown) that transports a recording sheet are arranged within the apparatus body 12, and a sheet feeding section (not shown) that accommodates a recording sheet is arranged at a lower portion of the apparatus body 12. Also, a sheet ejection section 16 that ejects a recording sheet on which an image is formed is formed substantially at the center of an upper wall portion 12A of the apparatus body 12.

Additionally, the cover member 22, which has a rotation center having the left-and-right direction as an axial direction located on a lower end portion side (one end side) and which opens and closes an opening portion 18 formed on a front portion side of the apparatus body 12, is provided on a front wall portion 12B side of the apparatus body 12 above the sheet feeding section. The cover member 22 is adapted such that, in the closed state where the opening portion 18 is closed, an upper wall portion 22A thereof constitutes a portion of the upper wall portion 12A that constitutes the opening portion 18 of the apparatus body 12, and a front wall portion 22B thereof covers the front wall portion 12B that constitutes the opening portion 18 of the apparatus body 12 from a front side.

Also, the cover member 22 includes a side wall portion 24 that has an "L" shape as viewed from the left-and-right direction, and is adapted so as to be matched with a cutout portion 14A formed on a front portion side and an upper portion side of a side wall portion 14 of the apparatus body 12 to constitute a portion of the side wall portion 14. In addition, a portion of the side wall portion 24 that extends in the up-and-down direction in the closed state of the cover member 22 is hereinafter referred to as a side wall portion 24A.

The cover member 22 is configured so as to be rotatable with the left-and-right direction (width direction of the apparatus body 12) as a rotating shaft direction by a rotating shaft 26 (refer to FIG. 4) provided at a lower end portion of the side wall portion 24A being rotatably supported by the apparatus body 12. Also, the closed state and the opened state of the cover member 22, are maintained by a cover opening/closing structure 20.

In addition, since the cover opening/closing structure according to the present exemplary embodiment has a symmetrical shape, the cover opening/closing structure 20 on one side (right side) will be described below. Additionally, the inside and the outside are represented relative to the apparatus body 12.

Figure 2:
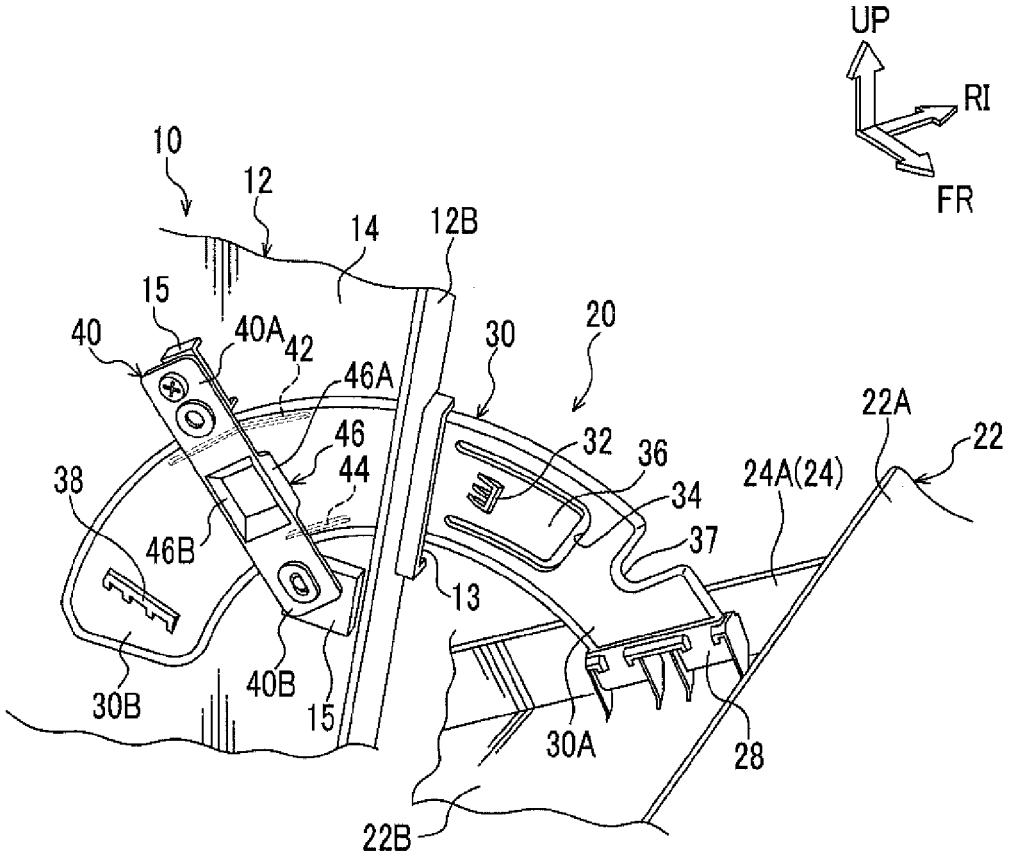
FIG. 2 is a schematic perspective view showing the cover opening/closing structure according to the present exemplary embodiment.
Figure 3:
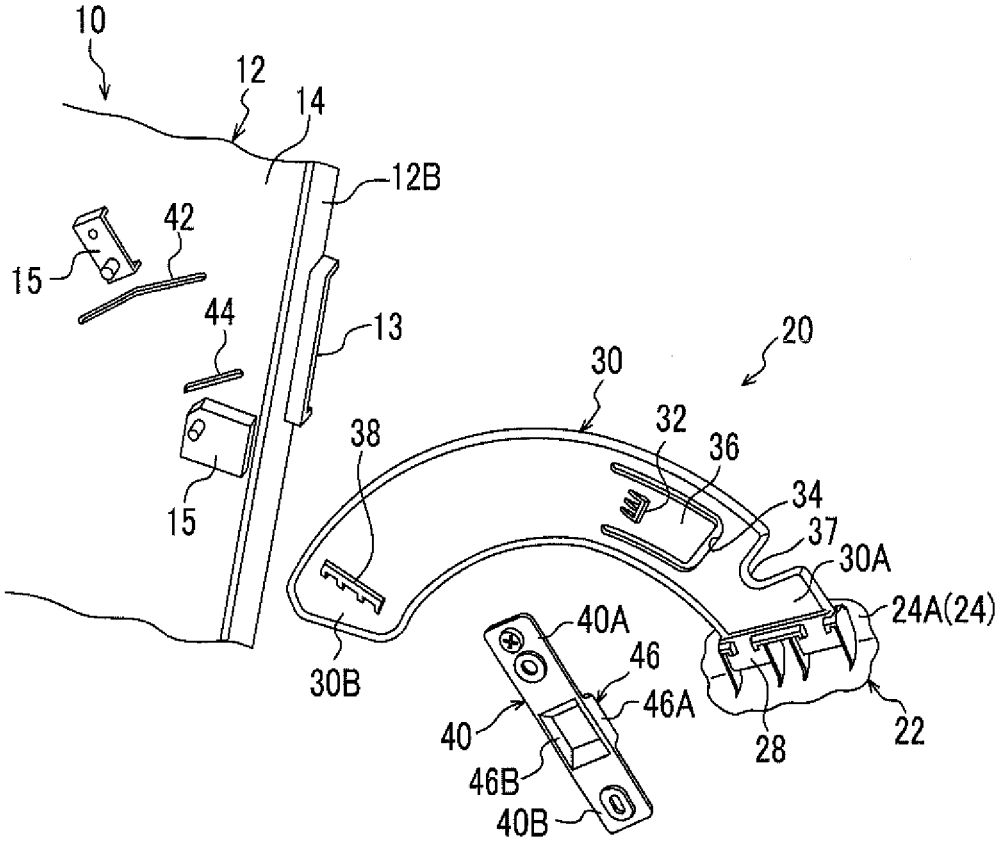
FIG. 3 is an exploded perspective view showing the configuration of the cover opening/closing structure according to the present exemplary embodiment.

As shown in FIGS. 2 and 3, the cover opening/closing structure 20 includes a strap member 30 as an example of a supporting member that includes one longitudinal end portion 30A fixed to the side wall portion 24A of the cover member 22 via a bracket 28, and a hold member 40 as an example of an engaging member that is provided on an inner surface side of the side wall portion 14 of the apparatus body 12 and engages the strap member 30.

The strap member 30 is formed in a substantially flat plate shape having the left-and-right direction as a thickness direction, and is formed in a circular-arc shape (curved shape) centered on the rotating shaft 26 as viewed from the left-and-right direction, a direction along the circular-arc shape is set as a longitudinal direction, and the radial direction of the circular-arc shape is set as a width direction.

Also, the strap member 30 is inserted through a slit-shaped insertion hole 13 that is formed in the front wall portion 12B of the apparatus body 12 and is long in the up-and-down direction. Accordingly, the insertion hole 13 has an inside dimension slightly greater than the outside dimension of the strap member 30, in a front view in which the apparatus body 12 is viewed from the front side.

Figure 5:
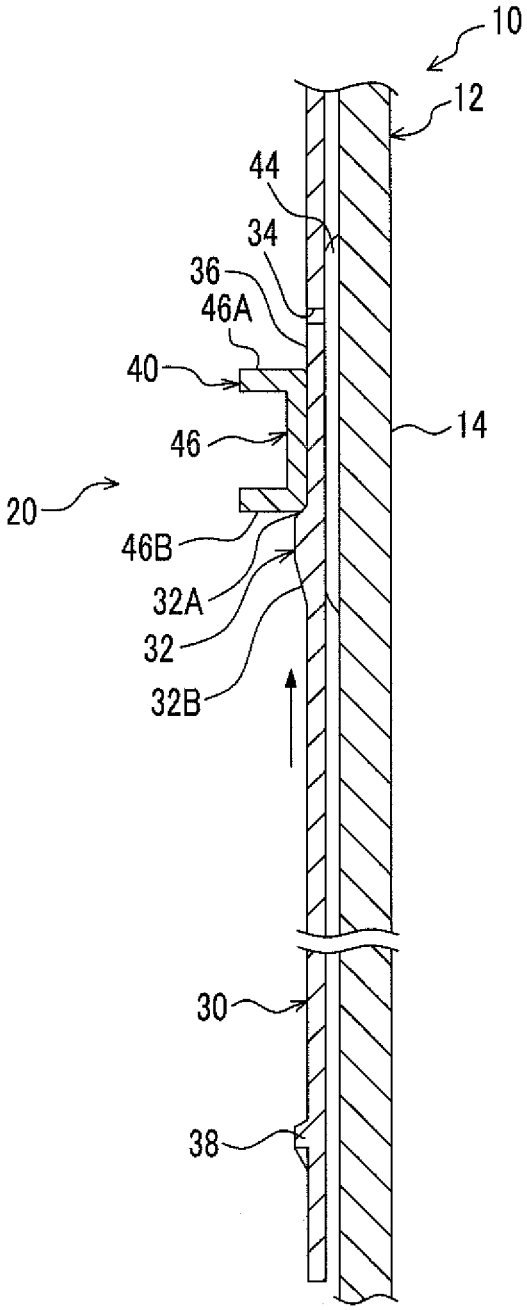
FIG. 5 is a schematic cross-sectional view showing a state of a strap member and a hold member when the cover member in the present exemplary embodiment is closed, along the longitudinal direction of the strap member.

A projection portion 32 as an example of a portion to be engaged is provided to protrude toward the inner side of the apparatus body 12 from a middle portion of the strap member 30 in a width direction, on an inner surface of the strap member 30 in a longitudinal halfway portion. In addition, as shown in FIG. 5, a rear wall portion of the projection portion 32 is formed with a tapered surface 32B for easy ride over to a front wall portion 46A of a pressing portion 46 (to be descried below) of the hold member 40 at the time of the closing operation of the cover member 22.

Also, a front wall portion of the projection portion 32 is formed with a tapered surface 32A for easy ride over to a rear wall portion 46B of the pressing portion 46 at the time of the opening operation of the cover member 22. In addition, the inclination angle of the tapered surface 32A in the front wall portion of the projection portion 32 is made greater than the inclination angle of the tapered surface 32B in the rear wall portion of the projection portion 32 so that the tapered surface may be engaged with (locked to) the rear wall portion 46B of the pressing portion 46 at the time of the completion of the closing operation of the cover member 22.

Additionally, as shown in FIGS. 2 and 3, the strap member 30, around the projection portion 32 excluding the other longitudinal end portion 30B side, is formed with a substantially U-shaped slit portion 34. Accordingly, a portion of the strap member 30 from which the projection portion 32 is provided to protrude is formed with a tongue piece 36 that is elastically deformable in the left-and-right direction (the rotating shaft direction of the cover member 22), with the other longitudinal end portion 30B side as a center.

Additionally, a cutout portion 37 is provided on the one longitudinal end portion 30A side of the strap member 30. The cutout portion 37 is formed so as to be cut out to the inside in the width direction (in a direction orthogonal to the axial direction of the rotation center) from the circular-arc shaped appearance (outer edge portion) of the strap member 30. In the cutout portion 37, the width of the strap member 30 is shorter compared to the width of other portions.

Additionally, the cutout portion 37 is provided further toward the cover member 22 side (position near the cover member 22) than the projection portion 32 (slit portion 34), and the cutout portion 37 passes through the insertion hole 13 after the projection portion 32 passes through the insertion hole 13 when the cover member 22 blocks the opening portion 18.

Additionally, a locking portion 38 locked to the rear wall portion 46B (apparatus body 12) of the pressing portion 46 in the opened state of the cover member 22 is provided to protrude from the middle portion of the strap member 30 in the width direction, on the inner surface of the strap member 30 in the other longitudinal end portion 30B. The locking portion 38 extends in the width direction of the strap member 30, and has rigidity (strength) capable of supporting the cover member 22 in the opened state.

The hold member 40 is formed in a substantially rectangular planar shape having the width direction of the strap member 30 as a longitudinal direction, and is laid between a pair of mounting platforms 15 provided to protrude from the inner surface of the side wall portion 14 at an interval that is equal to or greater than the width of the strap member 30. In detail, one longitudinal end portion 40A and the other longitudinal end portion 40B of the hold member 40 are attached to the respective mounting platforms 15 by screw stoppers or the like, respectively.

Additionally, a pair of ribs 42 and 44 as an example of protruding portions with which the strap member 30 slidably contacts with are provided to protrude from the inner surface of the side wall portion 14 between the mounting platforms 15. The respective ribs 42 and 44 are formed so as to extend along a circumferential direction (sliding direction) of the strap member 30, and the upper rib 42 is formed to be longer than the lower rib 44.

Figure 4:
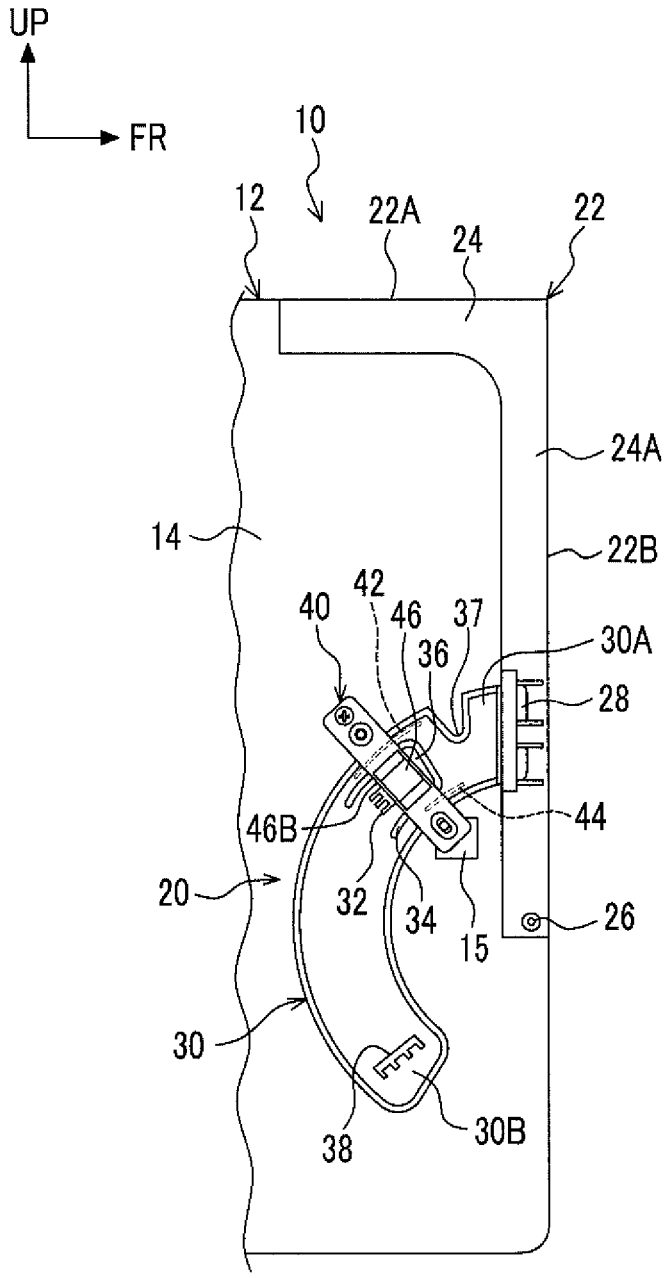
FIG. 4 is a schematic side view showing a closed state of a cover member in the present exemplary embodiment.

The respective ribs 42 and 44 contact with both ends in the width direction in the external face (surface directed to the outside in the left-and-right direction) of the strap member 30 from the outside in the left-and-right direction, and as shown in FIG. 4, the tongue piece 36 passes between the pair of ribs 42 and 44. That is, the pair of ribs 42 and 44 are adapted so as not to hinder the elastic deformation of the tongue piece 36 in the left-and-right direction.

Additionally, the pressing portion 46 that protrudes in a substantially rectangular planar shape to the strap member 30 side (to the outside in the left-and-right direction) is integrally formed on the halfway portion of the hold member 40 in the longitudinal direction. The pressing portion 46, as shown in FIG. 4, is formed with a size such that the pressing portion is arranged among the pair of ribs 42 and 44 as viewed from the left-and-right direction, and presses the middle portion of the inner surface (surface directed to the inside in the left-and-right direction) of the strap member 30 in the width direction from the inside in the left-and-right direction, with the opening/closing operation of the cover member 22.

In detail, as shown in FIG. 5, the interval between tip portions of the pair of ribs 42 and 44, and the pressing portion 46 is made smaller than the plate thickness of the strap member 30 by, for example, 0.2 mm. Accordingly, the pair of ribs 42 and 44 contact with the external face (surface to be contacted) of the strap member 30 from the outside in the left-and-right direction, and the pressing portion 46 presses the inner surface (surface to be pressed) of the strap member 30 from the inside in the left-and-right direction (toward the outside in the left-and-right direction).

That is, the strap member 30 is pinched from the left-and-right direction by the pair of ribs 42 and 44, and the pressing portion 46 of the hold member 40. Accordingly, sliding resistance (damper function) is given to the strap member 30, and the magnitude of the sliding resistance (friction) is adjusted by appropriately setting the above interval (protruding height of the pressing portion 46) and the above plate thickness.

In addition, as described above, the locking portion 38 is locked to the rear wall portion 463 of the pressing portion 46 when the cover member 22 opens the opening portion 18

Figure 8:
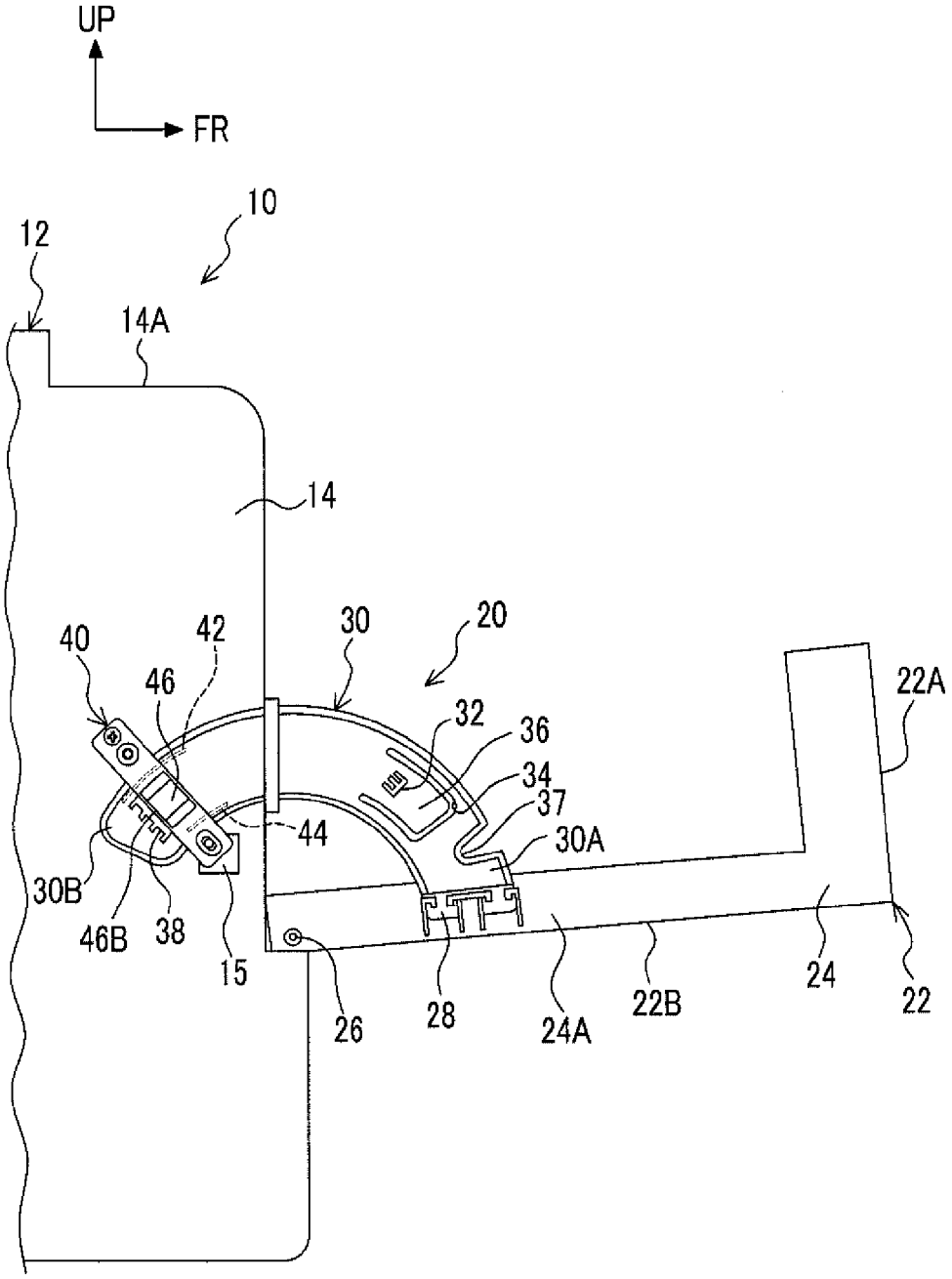
FIG. 8 is a schematic side view showing an opened state of the cover member in the present exemplary embodiment.
Figure 9:
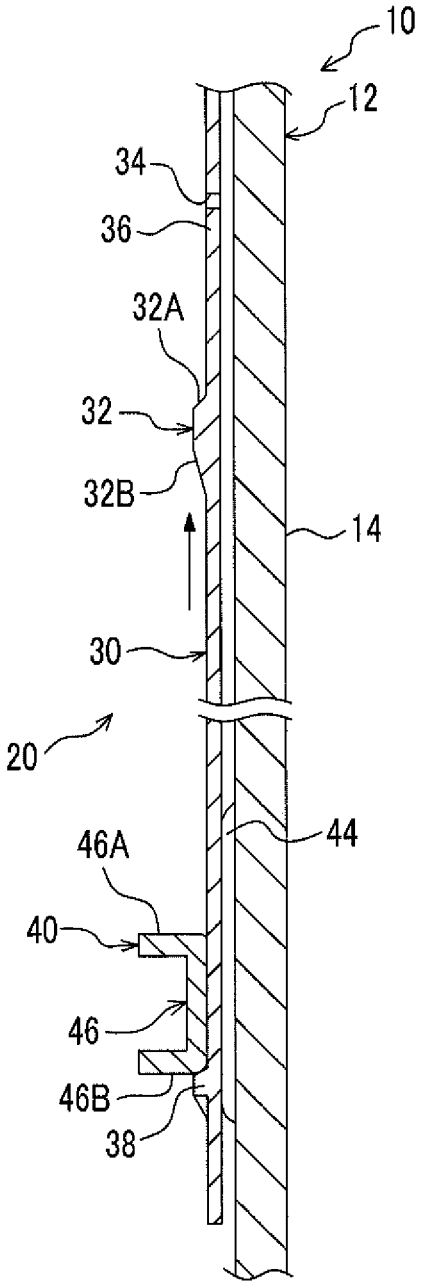
FIG. 9 is a schematic cross-sectional view showing a state of the strap member and the hold member when the cover member in the present exemplary embodiment is opened, along the longitudinal direction of the strap member.

(refer to FIGS. 8 and 9). Also, the projection portion 32 of the strap member 30 engages the rear wall portion 46B of the pressing portion 46 when the cover member 22 closes the opening portion 18.

In detail, as shown in FIG. 4, the front wall portion of the projection portion 32 engages the rear wall portion 46B of the pressing portion 46 so as to prevent the opening of the cover member 22 in the closed state of the cover member 22. This maintains the closed state of the cover member 22. That is, the cover member 22 is locked so as not to rotate with respect to the apparatus body 12.

When the cover member 22 opens the opening portion 18, the projection portion 32 (tapered surface 32A) is pressed by the pressing portion 46 toward the outside in the left-and-right direction with an opening operation (rotation) centered on the rotating shaft 26 of the cover member 22. Thus, the tongue piece 36 from which the projection portion 32 is provided to protrude is elastically deformed to the outside in the left-and-right direction. This releases the locking (engagement of the projection portion 32) of the cover member 22 to the apparatus body 12.

Additionally, when the cover member 22 blocks the opening portion 18, the projection portion 32 (tapered surface 32B) bumps against the front wall portion 46A of the pressing portion 46 and is pressed by the pressing portion 46 toward the outside in the left-and-right direction with a closing operation (rotation) centered on the rotating shaft 26 of the cover member 22. Thus, the tongue piece 36 from which the projection portion 32 is provided to protrude is elastically deformed to the outside in the left-and-right direction. Then, as the elastic deformation is recovered, the front wall portion of the projection portion 32 engages the rear wall portion 46B of the pressing portion 46. This locks the cover member 22 to the apparatus body 12.

In this way, in the cover opening/closing structure 20 according to the present exemplary embodiment, a damper function for the strap member 30, and a locking function (latching function) for the cover member 22 are given to the hold member 40 (the hold member 40 is used for both the damper function and the locking function (latching function)). Additionally, the strap member 30 or the hold member 40 is made of resin, such as ABS (acrylonitrile butadiene styrene) or PC (polycarbonate).

In the cover opening/closing structure 20 having the configuration as described above, next, the process thereof will be described.

For example, when maintenance of the image forming section provided within the apparatus body 12 is performed, the opening portion 18 of the apparatus body 12 is opened by rotating the cover member 22 around the rotating shaft 26. At this time, since the damper function is given to the cover member 22 by the cover opening/closing structure 20, the cover member 22 performs an opening operation (rotation) gently.

In detail, when the upper wall portion 22A side of the cover member 22 is pulled toward the front (opening direction) in the closed state of the cover member 22 shown in FIGS. 4 and 5, the front wall portion in the projection portion 32 of the strap member 30 is pressed toward the outside in the left-and-right direction by the pressing portion 46 of the hold member 40 while the cover member 22 rotates in the clockwise direction in FIG. 4 around the rotating shaft 26.

Figure 6:
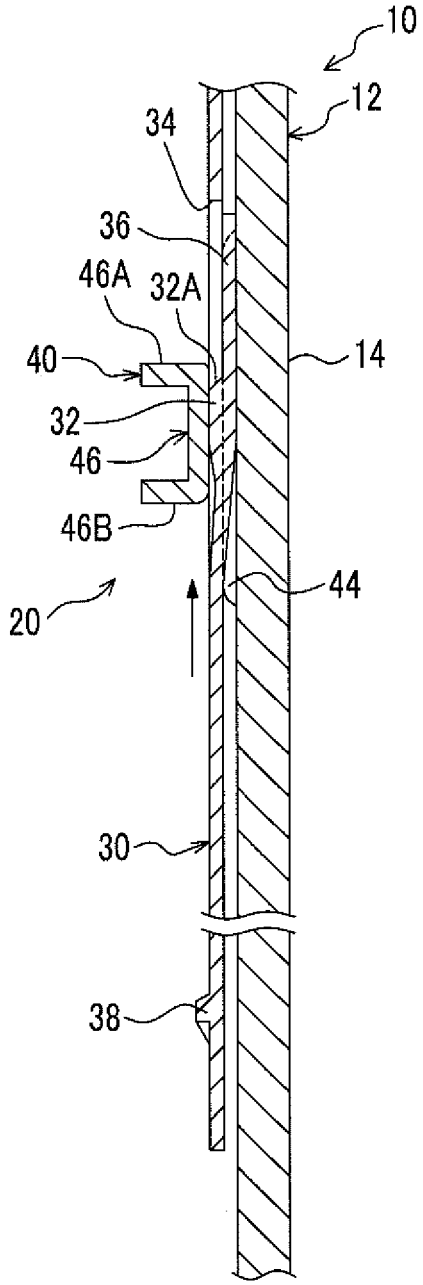
FIG. 6 is a schematic cross-sectional view showing a state of the strap member and the hold member when the cover member in the present exemplary embodiment is opened, along the longitudinal direction of the strap member.

Then, as shown in FIG. 6, since the tapered surface 32A is formed on the front wall portion of the projection portion 32, the projection portion 32 rides over the pressing portion 46 smoothly while the tongue piece 36 is elastically deformed to the outside in the left-and-right direction. In addition, the maximum height of the projection portion 32 is set as a height such that the projection portion may ride over the pressing portion 46 even when the elastic deformation of the tongue piece 36 to the outside in the left-and-right direction is regulated by the side wall portion 14.

Figure 7:
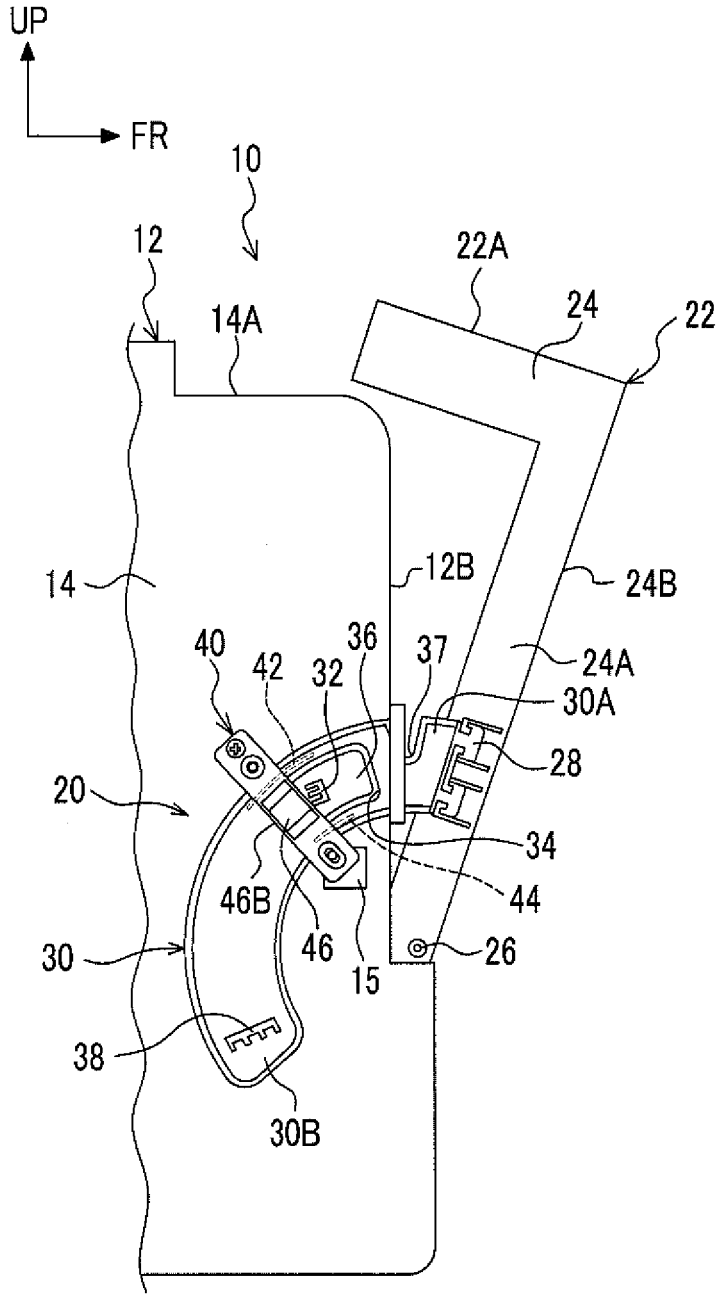
FIG. 7 is a schematic side view showing a state in the middle of opening/closing of the cover member in the present exemplary embodiment.

When the engagement (locking) with the pressing portion 46 by the projection portion 32 of the cover member 22 is released in this way, as shown in FIG. 7, the sliding resistance (friction) caused by the strap member being pinched by the pair of ribs 42 and 44 and the pressing portion 46 from the outside and the inside in the left-and-right direction is given to the strap member 30. Thus, the cover member 22 performs an opening operation (rotation) gently with the lower end portion side (rotating shaft 26) as a rotation center.

That is, the cover member 22 is kept or prevented from opening roughly, and the opening portion 18 of the apparatus body 12 is opened by the termination of the opening operation (rotation centered on the rotating shaft 26). In addition, as shown in FIGS. 8 and 9, when the locking portion 38 of the strap member 30 is locked to the rear wall portion 46B of the pressing portion 46, the opening operation (rotation centered on the rotating shaft 26) of the cover member 22 is stopped.

On the other hand, when the maintenance work of an image forming section is terminated, the upper wall portion 22A side of the cover member 22 is pushed in rearward (in the closed direction) (is rotated in an opposite direction around the rotating shaft 26), but the cover member 22 performs a closing operation (rotation) gently at this time. That is, since the strap member 30 slides in a direction opposite to that when the cover member 22 performs an opening operation while being pinched by the pair of ribs 42 and 44 and the pressing portion 46 (while friction is given), the strap member 30 is kept or prevented from operating to close roughly.

Then, as shown in FIG. 7, when the rear wall portion in the projection portion 32 of the strap member 30 bumps against the front wall portion 46A of the pressing portion 46, the projection portion 32 is pressed toward the outside in the left-and-right direction by the pressing portion 46. Then, since the tapered surface 32B is formed on the rear wall portion of the projection portion 32, the projection portion 32 rides over the pressing portion 46 smoothly while the tongue piece 36 is elastically deformed to the outside in the left-and-right direction.

Then, as shown in FIG. 4, as the elastic deformation of the tongue piece 36 is recovered, the front wall portion of the projection portion 32 engages the rear wall portion 46B of the pressing portion 46, and the opening portion 18 of the apparatus body 12 is closed by the cover member 22. That is, the cover member 22 is locked to the apparatus body 12.

Although the cover member 22 is locked to the apparatus body 12 in the above-described way, when the projection portion 32 rides over the pressing portion 46 and recovers, a portion of the tongue piece 36 located further toward the one end portion 30A side than the projection portion 32 bumps against the pressing portion 46, and thus latch sound is generated. Accordingly, the locking of the cover member 22 to the apparatus body 12 is confirmed.

In this way, in the cover opening/closing structure 20 according to the present exemplary embodiment, the locking function (latching function) and the damper function are given to the strap member 30 (cover member 22) by the pressing portion 46 of the hold member 40. Thus, the number of parts may be reduced compared to a configuration in which a locking mechanism (latching function) or a damper mechanism are given separately from the hold member 40.

Additionally, the cover opening/closing structures 20 are provided on both the right and left sides of the apparatus body 12 and the cover member 22. Accordingly, even when the cover member 22 is pushed in the direction in which the opening portion 18 is blocked (even when the cover member 22 is operated to close), for example, in a state where the cover member 22 is twisted with respect to the apparatus body 12, the strap member 30 slides while being pinched by the pair of ribs 42 and 44 and the pressing portion 46. Thus, the twisting of the cover member 22 is corrected.

Hence, for the locking (latching) of the cover member 22, for example, even when a hook-shaped snap member (not shown) is provided at the cover member 22 and a snap receiving member (not shown) is provided at the apparatus body 12, the snap member does not easily deviate from a regular track, and the snap member does not bump against the snap receiving member. That is, there is no possibility that the snap member or the snap receiving member may be damaged.

Additionally, according to the cover opening/closing structure 20 according to the present exemplary embodiment, the snap member and the snap receiving member may not be provided at the cover member 22 and the apparatus body 12, respectively. Accordingly, compared to a case where the snap member and the snap receiving member are provided, there is an advantage that the shape of the cover member 22 or the apparatus body 12 is not restricted (the appearance thereof is not influenced).

Additionally, the cover opening/closing structure 20 according to the present exemplary embodiment has a configuration in which the strap member 30 is pinched in the left-and-right direction by the pair of ribs 42 and 44 and the pressing portion 46 of the hold member 40 (is pressed from the left-and-right direction to generate friction). Therefore, for example, compared to a configuration in which both end faces of the strap member 30 in the width direction are pinched (are pressed from the up-and-down direction to generate friction), the cover member 22 is easily assembled to the apparatus body 12, and the magnitude of the sliding resistance (friction) is adjusted by appropriately setting the protruding height of the pressing portion 46. Thus, there is an advantage that adjustment is easy.

Additionally, when the cover member 22 blocks the opening portion 18, for example, when one side of right and left sides of the cover member 22 is pressed and blocked, the projection portion 32 may not gently pass through the insertion hole 13 and the front wall portion 46A due to deflection deformation of the cover member 22, the strap member 30, or the like, and the closing operation of the cover member 22 may stop depending on the case.

However, according to the cover opening/closing structure 20 according to the present exemplary embodiment, the strap member 30 has a certain degree of elasticity even in a direction of the closing operation by the cutout portion 37. Thus, even when the cover member 22 is going to stop in the middle of the closing operation and a user is going to close the cover member 22 further from the stopped state, a force with that the user is going to close the cover member 22 is absorbed by the cutout portion 37. This reduces the possibility of damage of the strap member 30 or the like.

Although the cover opening/closing structure 20 according to the present exemplary embodiment has been described with reference to the drawings, the cover opening/closing structure 20 according to the present exemplary embodiment is not limited to the illustrated one, and appropriate design changes may be made without departing from the concept of the invention. For example, the shape of the pressing portion 46 of the hold member 40 is not limited to the illustrated substantially rectangular planar shape.

Additionally, the position where the hold member 40 is provided is also not limited to the illustrated position, and is appropriately set depending on the length of the strap member 30, the position of the locking portion 38, or the like. Additionally, the pair of ribs 42 and 44 may be configured to be provided to integrally protrude not from the inner surface of the side wall portion 14 of the apparatus body 12 but from the external face of the strap member 30.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cover structure comprising:

a cover member that pivots between open and closed positions relative to an apparatus body with one end of the cover member acting as an axis of rotation of the cover member;

a supporting member that includes one end portion fixed to the cover member and supports the cover member in the open position;

an engaging member provided on the apparatus body to give resistance to movement of the supporting member as the supporting member moves with the cover member as the cover member moves between the open and closed positions, and the engaging member engages a portion of the supporting member when the cover member is in the closed position to maintain the cover member in the closed position;

and a protruding portion which protrudes from the apparatus body and which slidably contacts the supporting member, wherein the supporting member includes a locking portion which engages the engaging member when the cover member is in the open position to prevent the cover member from moving in a direction from the closed position toward the open position, the locking portion extending in a width direction of the supporting member, and the locking portion including a substantially linear face, wherein the supporting member resists the movement of the cover member between the open and closed positions by being pinched between the engaging member and the protruding portion, and wherein the portion of the supporting member is elastically deformed in a direction parallel to the axis of rotation as the cover member moves between the open and closed positions and as the portion of the supporting member engages and disengages with the engaging member.

2. The cover structure according to claim 1, wherein the supporting member includes a cutout portion which extends into the supporting member in a direction orthogonal to the axis of rotation.

3. A cover structure according to claim 2, wherein the cutout portion is closer to the cover member than the portion of supporting member.

4. An image forming apparatus comprising:

the cover structure according to claim 1.

* * * * *